US007398568B1

(12) United States Patent
Clark et al.

(10) Patent No.: US 7,398,568 B1
(45) Date of Patent: Jul. 15, 2008

(54) BEDDING FOUNDATION

(75) Inventors: R. Kent Clark, Webb City, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 70 days.

(21) Appl. No.: 11/619,741

(22) Filed: Jan. 4, 2007

(51) Int. Cl.
*A47C 23/05* (2006.01)

(52) U.S. Cl. ..... 5/247; 5/255; 5/263; 5/264.1; 267/100

(58) Field of Classification Search ..... 5/247, 5/255, 263, 264.1; 267/100, 101
See application file for complete search history.

(56) References Cited

U.S. PATENT DOCUMENTS 3,858,862 A * 1/1975 Ciampa et al. ..... 267/100
5,052,064 A * 10/1991 Hagemeister et al. ..... 5/246
5,361,434 A * 11/1994 Hagemeister et al. ..... 5/247
5,622,357 A * 4/1997 Schulz et al. ..... 267/103
5,639,071 A * 6/1997 Kitchen ..... 267/100
5,704,595 A * 1/1998 Kitchen et al. ..... 267/103
5,749,108 A * 5/1998 Barnett ..... 5/264.1
5,778,466 A 7/1998 Price
6,264,179 B1 7/2001 Bullard
6,484,339 B2 11/2002 Mossbeck et al.
6,578,213 B2 6/2003 Dabney
7,237,282 B2 * 7/2007 Beck et al. ..... 5/247

* cited by examiner

*Primary Examiner*—Michael Trettel
(74) *Attorney, Agent, or Firm*—Wood, Herron & Evans, LLP

(57) ABSTRACT

A stackable wire core assembly for a bedding foundation which may be nestably stacked with numerous other such assemblies for transportation, thereby avoiding the need to compress and tie the assembly for shipping. The wire core assembly includes corrugated formed support wires having inverted U-shaped channels formed at the bottom of the corrugated formed support wires adapted to be wrapped over and secured to slats of a wooden base frame.

16 Claims, 3 Drawing Sheets

BEDDING FOUNDATION

FIELD OF THE INVENTION

This invention relates generally to bedding, and more particularly, to a formed wire bedding foundation.

BACKGROUND OF THE INVENTION

Bedding foundations or so-called box spring assemblies generally comprise spaced border wires between which are disposed coil or bent wire spring modules. As thus manufactured, these box spring assemblies are bulky for shipping to a manufacturer where padding and covering are applied thereto. In order to reduce shipping space requirements, it is customary to compress the assemblies to reduce their individual thicknesses and, when compressed, to tie them in their compressed state. This involves providing presses and ties which are expensive, and the extra operations of pressing and tying the assemblies. At the delivery end, the manufacturer must cut and discard the ties before applying the covering. These additional material and handling costs increase the end cost of box spring assemblies.

In U.S. Pat. No. 5,052,064, there is disclosed a nestably stackable bedding foundation assembly which overcomes the manufacturing and shipping problems characteristic of the more traditional coil or modular spring bedding foundations. The bedding foundation assembly of U.S. Pat. No. 5,052,064 comprises a rectangular border wire and transversely spaced, parallel and longitudinally extending support wires parallel to the border wire sides and having ends connected to the border wire. These support wires are generally corrugatedly formed along their lengths, having peaks and valleys with the peaks being generally co-planar with the plane defined by the border wire and the valleys being displaced beneath and intermediate of the peaks. Longitudinally spaced, parallel and transversely extending upper connector wires, parallel to the border wire ends, are connected along their lengths to the peaks of the support wires. Longitudinally spaced, parallel and transversely extending lower connector wires, parallel to the border wire ends, are connected to the valleys of the support wires. The longitudinal voids between the peaks of the support wires are of a greater dimension than the valleys of the support wires. This configuration enables one nestably stackable bedding foundation assembly to be nestedly stacked atop a second assembly since the support wire valleys of the first assembly may enter into the voids between the peaks of the support wires of the second assembly. Such a nestedly stacked arrangement results in a total height dimension which is less than the sum of the individual assembly height dimensions.

The primary advantage of the bedding foundation assembly of U.S. Pat. No. 5,052,064 is that it enables relatively inexpensive bedding foundation wire cores to be tightly compacted and shipped in a minimum of space to an assembly destination, thereby reducing the ultimate cost of the core to the assembler. The bedding foundation of U.S. Pat. No. 5,052,064 also has the advantage that it may be rapidly loaded by a manufacturer for transportation to the destination of assembly without the need for compressing and tying the assemblies.

SUMMARY OF THE INVENTION

The present invention is directed to a nestably stackable wire core bedding foundation which has all of the advantages of the bedding foundation of the '064 patent, but which is of greater compressive support to the complete foundation unit than is characteristic of the wire core bedding foundation of U.S. Pat. No. 5,052,064. In the present invention, as in the foundation disclosed in U.S. Pat. No. 5,052,064, the foundation comprises a rectangular border wire and lengthwise or transversely extending parallel support wires connected at opposite ends to opposite ends or opposite sides of the border wire. And, as in the '064 patent, these support wires are generally corrugatedly formed along their lengths, having peaks and valleys with the peaks being generally co-planar and in the plane of the border wire and the valleys being displaced beneath and intermediate of the peaks. And, also as in the '064 patent, there are multiple, parallel connector wires extending normal to the support wires in the plane of the border wire, which connection wires are fixedly attached at their opposite ends to the border wire and are attached intermediate of their ends to the peaks of the support wires. But unlike the support wires of the '064 patent, the valleys of the support wires of the present invention have an inverted U-shaped channel formed therein, which channel is sized and shaped to wrap around the top and sides of slats of a foundation base to which the valleys of the support wire are attached. Thereby, the resulting foundation is given additional compressive strength which has not been characteristic of prior art wire core bedding foundations.

In one embodiment of the present invention, the valleys of the support wires of the wire core assembly are stapled to the top surface of the slats. In another embodiment of the present invention, the sides of the channels formed in the valleys of the support wires have barbs formed on the inside surface of the wire such that the complete wire grid may be pressed onto wooden slats of the base frame to secure the grid to the base frame without the need for any staples to make that securement.

In a preferred embodiment of the invention, the support wires are welded to the connector wires in pairs with the valleys of the support wires of a pair sloping downwardly and inwardly toward one another at an included angle of approximately 35° so as to optimize the ease of stacking of multiple wire cores for purposes of storing and shipping stacks of nestably stacked wire core assemblies.

The primary advantage of the invention of this application is that it increases the compressed load strength of a bedding foundation incorporating this wire core assembly over prior art nestably stackable wire core bedding foundations by transferring compressive forces on the wire core from the wire core assembly to the underlying slats of the foundation base.

These and other advantages of the present invention will more readily become apparent from the description of the drawings herein, in which:

DESCRIPTION OF THE PREFERRED EMBODIMENTS

Figure 1:
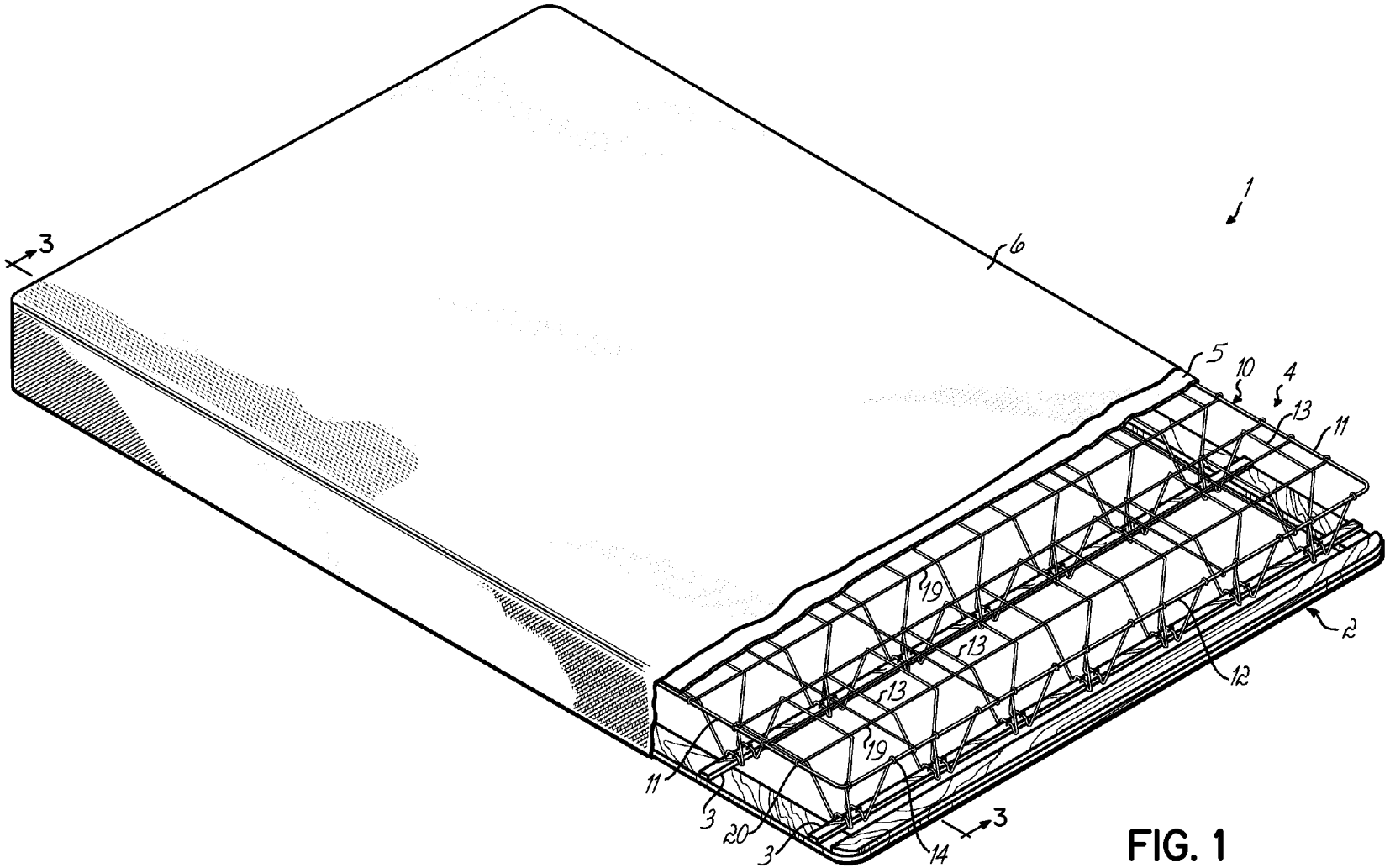
FIG. 1 is a perspective view, partially broken away, of a bedding foundation assembly embodying the invention of this application.

Referring first to FIG. 1, a bedding foundation 1 is illustrated. The foundation 1 has a rectangular wooden base frame 2 on which are attached transverse wooden slats 3. Atop these transverse slats 3 is the nestably stackable assembly or wire core 4. A foam pad 5 overlies the nestably stackable assembly 4, and a fabric covering 6 overlies the foam pad 5 and surrounds the nestably stackable assembly 4 and the base frame 2.

Describing the nestably stackable assembly 4 now in more detail, it comprises a rectangular steel border wire 10 having two parallel sides 11, 11 and two parallel ends 12, 12, with the parallel sides 11, 11 being longer than the parallel ends 12, 12. Transversely spaced, parallel and longitudinally extending steel support wires 13 are parallel to the border wire sides 11, 11 and have ends 14 which are crimped around the ends 12, 12 of the border wire 10. These support wires 13 are formed so as to be generally corrugatedly shaped along their lengths, having peaks 15 and valleys 16 (see FIG. 3). These peaks 15 are generally co-planar with the plane defined by the border wire 10, with the valleys 16 being vertically spaced beneath and intermediate of the flattened peaks 15.

Longitudinally spaced, parallel and transversely extending steel upper connector wires 19 extend parallel to the border wire ends 12, 12 and have ends 20 which are crimped around the border wire sides 11, 11. These upper connector wires 19 are welded intermediate of their ends along their lengths 21 to the flattened peaks 15 of the support wires 13.

The valleys 16 of each support wire 13 have an inverted U-shaped channel 17 formed therein. Each channel 17 has a flat upper section 18 from which side sections 19 extend downwardly. These side sections 19 are connected to the lower ends 21 of the riser sections 22 of the support wires 13.

Figure 2:
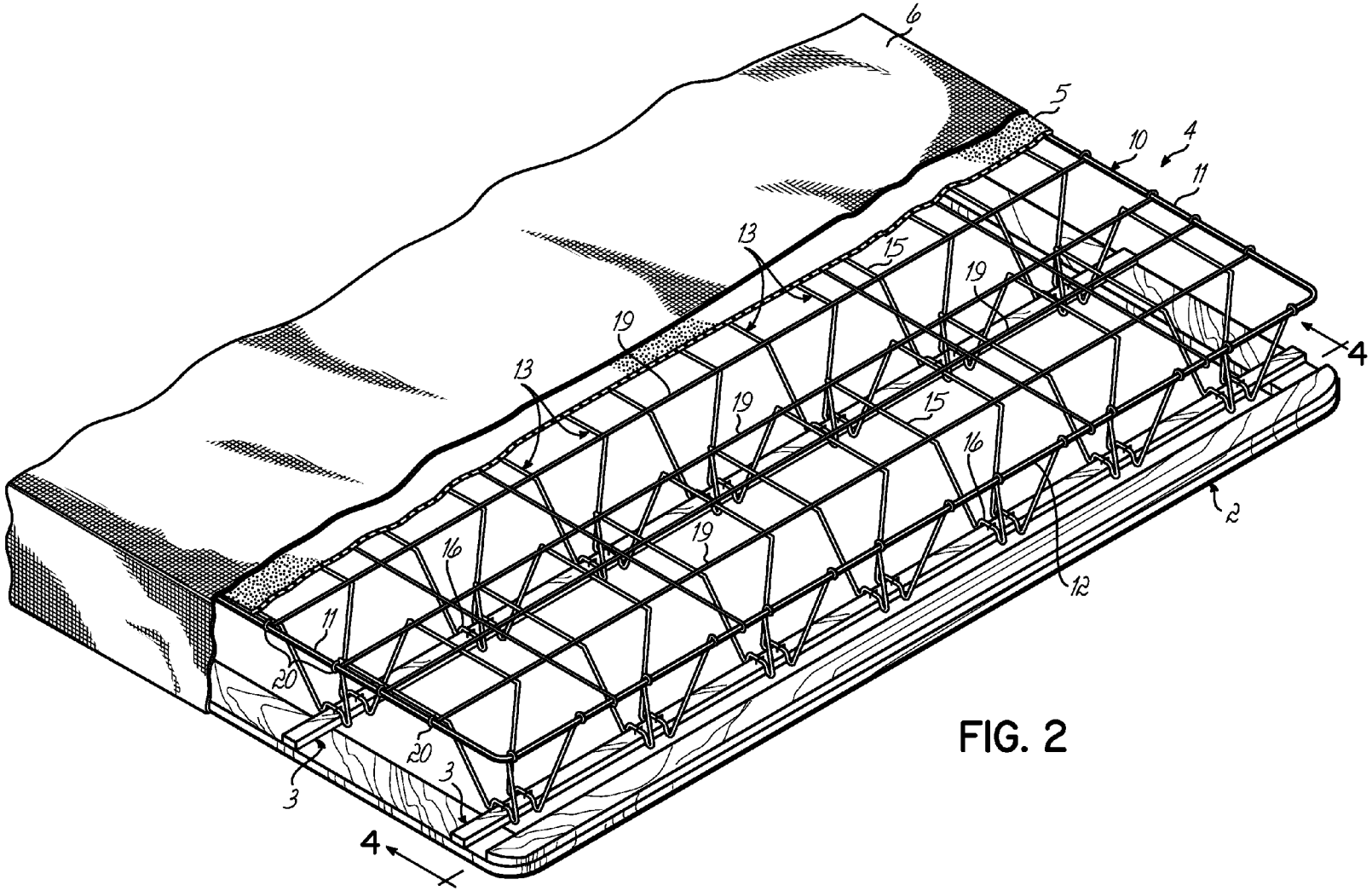
FIG. 2 is an enlarged perspective view of a portion of the bedding foundation of FIG. 1.
Figure 3:
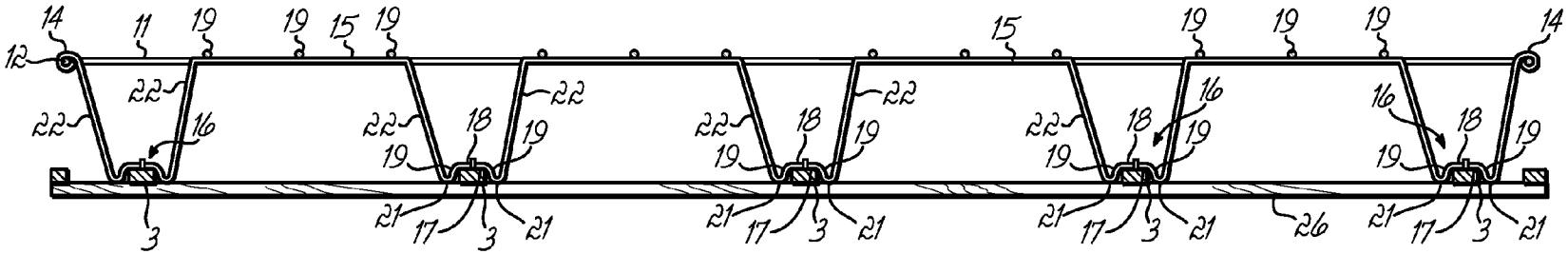
FIG. 3 is a view taken along line 3-3 of FIG. 1, but with the covering materials removed for purposes of illustrating the corrugatedly formed support wires.

With reference now to FIGS. 2 and 3, it will be seen that each channel-shaped section 17 of each support wire 13 fits over and wraps around the top surface and sides of a slat 3 of the base frame 2. In the embodiment of the invention illustrated in FIGS. 1-4 and 6, the top upper section 18 of each channel 17 of a support wire is secured by staples 23 to the top surface of a slat. But the channels of the support wires 13 could be connected to the slats by other connectors as, for example, as illustrated in FIG. 7, by barbs 24 formed on the inside edge of the downwardly extending sections 19 of the channels 17 formed in the valleys 16 of the support wires 13. In the event that barbs formed in the channels 17 of the support wires are used to connect the wire core 4 to the base frame 2, the completely assembled core may be simply pressed downwardly onto the base frame 2 to secure the assembled wire core to the base frame with the barbs 12 locked into the sides of the slats 3.

Figure 4:
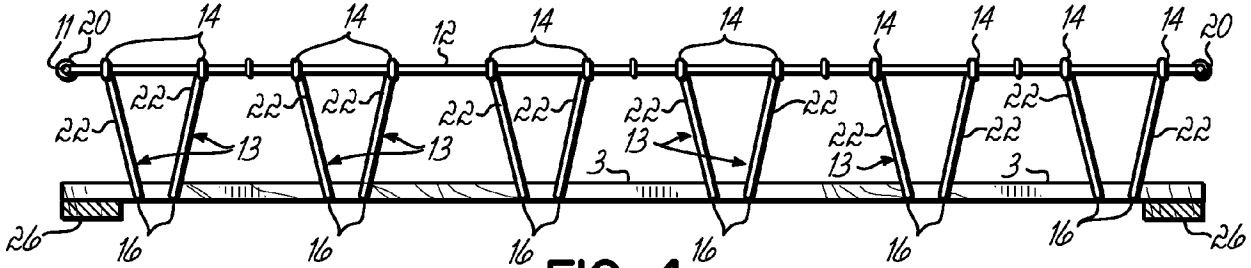
FIG. 4 is a view taken along line 4-4 of FIG. 2.
Figure 5:
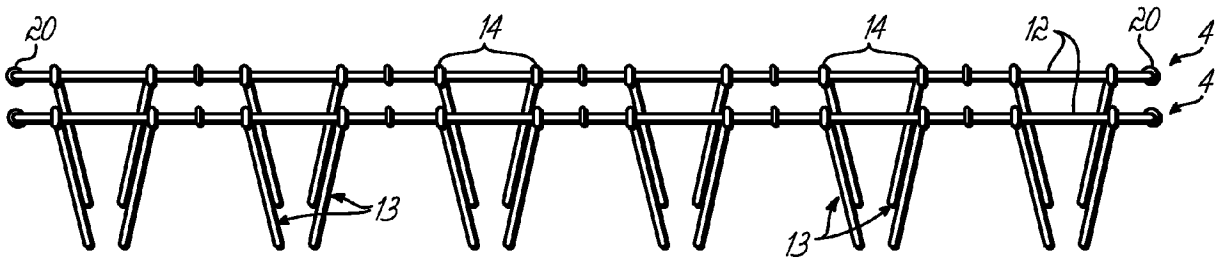
FIG. 5 is a view like FIG. 4, but illustrating two unmounted wire core assemblies stacked and nested one within the other for shipment.

With particular reference now to FIGS. 2 and 4, it will be seen that the support wires 13 are arranged in pairs with each pair having riser sections 22 extending downwardly and inwardly from the top peak sections 15. In one embodiment of the invention, these pairs of support wires define an included angle of approximately 35° therebetween. As illustrated in FIG. 5, this included angle between the pairs of support wires 13 facilitates nestable stacking of the assembled wire cores for shipment or storage before these assembled wire cores 4 are secured to base frames.

Figure 6:
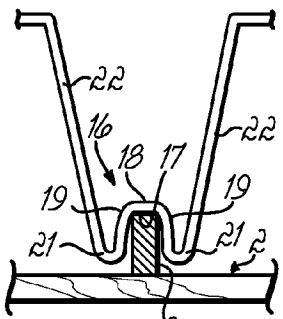
FIG. 6 is a view of a portion of a support wire mounted upon a slat of a base frame wherein the slat is nailed on edge to the base frame of a bedding foundation assembly.
Figure 7:
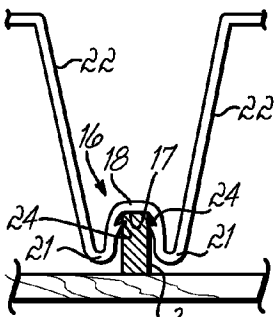
FIG. 7 is a view similar to FIG. 6, but of another embodiment of the support wire.

With reference to FIGS. 6 and 7, the slats 3 of the base frame 2 are there illustrated as being secured on edge as, for example, by nails (not shown) to the side boards 26 of the base frame 2. This differs from the slat of FIGS. 1-4 wherein the slats are illustrated as lying flat on the side boards. The advantage of this on-edge securement of the slats to the side boards is that it increases the height of the resulting foundation without any appreciable increase in cost of materials or assembly.

The metal core portion of a bedding foundation is generally manufactured by a supplier, who then ships it to an assembler. The assembler adds to the metal core a wooden base 2, slats 3, padding 5 and upholstery 6 to make a completed product.

With reference to FIG. 5, it will be seen that a first stackable assembly or core 4 may be placed upon a surface with the valleys 16 of the support wires 13 oriented downwardly and the flattened peaks 15 of the support wires 13 oriented upwardly. Next, a second like assembly 4 may be placed atop the first assembly 4, with its support wire valleys 16 and flattened support wire peaks 15 likewise oriented downwardly and upwardly, respectively. The valleys 16 of the second assembly 4 are thereby allowed to enter into the voids between the flattened peaks 15 of the first assembly 4. The second assembly 4 nestles downwardly within the first assembly 4 until the outside dimension of the valleys 16 of the second assembly 4 is equal to the inside dimension of the valleys 16 of the first assembly 4. At this point, the second assembly 4 comes to rest within the first assembly 4, with the overall height of the nested assemblies being substantially less than the sum of the individual heights of the assemblies. Of course, any number of assemblies may be nested and stacked together for storage or shipment.

The primary advantage of the invention of this application is that it facilitates storage and shipment of the nestably stackable wire core assemblies 4 and the resulting improved compressive strength of the foundation when the wire core is assembled onto a base frame. This improved compressive strength derives from any load or force placed atop the wire core being transferred by the wire core to the slats of the base frame about which the valleys of the support wires of the core are wrapped.

While we have described several embodiments of our invention, those persons skilled in the art will readily recognize modifications and changes which may be made without departing from the spirit or scope of the invention. Accordingly, we intend for our invention to be limited only by the following claims:

We claim:

1. A nestably stackable assembly for use in a bedding foundation comprising:

a rectangular border wire having two parallel sides and two parallel ends;

transversely spaced and longitudinally extending support wires parallel to said border wire sides and having ends connected to said border wire ends, said support wires being formed so as to be generally corrugated along their lengths, said corrugatedly formed support wires having peaks and valleys, tops of said peaks being co-planar with a plane defined by said border wire, said valleys being vertically displaced beneath and intermediate of said peaks;

longitudinally spaced, parallel and transversely extending upper connector wires parallel to said border wire ends and having ends connected to said border wire sides, said upper connector wires being connected intermediate of their ends along their lengths thereof to said peaks of said support wires; and said valleys of said support wires having generally inverted U-shaped channels formed at the bottom thereof, said channels of said valleys of said support wires being adapted to be wrapped about top and side wall surfaces of slats of a base frame of a bedding foundation.

2. The nestably stackable assembly of claim 1 wherein longitudinal voids between said peaks are of a dimension greater than said valleys.

3. The nestably stackable assembly of claim 2 being a first assembly, which, when placed atop a second assembly of like construction, is nestedly stacked thereon when said valleys of said first assembly enter into said voids between said flattened peaks of said second assembly, said nested assemblies having a total height dimension less than a sum of a height dimension of said first assembly and a height dimension of said second assembly.

4. The nestably stackable assembly of claim 1 wherein said support wires are arranged in pairs with each pair of said support wires being angled downwardly and inwardly toward one another.

5. The nestably stackable assembly of claim 4 wherein each pair of support wires define an acute angle therebetweeen.

6. The nestably stackable assembly of claim 4 wherein each pair of support wires define an included angle of approximately 35° therebetween.

7. The bedding foundation of claim 1 wherein side wall sections of said channels of said valleys of said support wires have barbs formed on an inside surface thereof, said barbs being adapted to be received within side wall surfaces of slats of a base frame.

8. A nestably stackable assembly for use in a bedding foundation comprising:

a rectangular border wire having two parallel sides and two parallel ends;

transversely spaced, parallel and longitudinally extending support wires parallel to said border wire sides and having ends connected to said border wire ends, said support wires being formed so as to be generally corrugated along their lengths, said corrugatedly formed support wires having peaks and valleys, said peaks being flattened at their tops, said flattened peaks being generally co-planar with a plane defined by said border wire, said valleys being vertically displaced beneath and intermediate of said flattened peaks;

longitudinally spaced, parallel and transversely extending upper connector wires parallel to said border wire ends and having ends connected to said border wire sides, said upper connector wires being connected intermediate of their ends along their lengths to said flattened peaks of said support wires; and said valleys of said support wires having generally inverted U-shaped channels formed at the bottom thereof.

9. The nestably stackable assembly of claim 8 wherein longitudinal voids between said flattened peaks are of a dimension greater than said flattened valleys.

10. The nestably stackable assembly of claim 9 being a first assembly, which, when placed atop a second assembly of like construction, is nestedly stacked thereon when said valleys of said first assembly enter into said voids between said flattened peaks of said second assembly, said nested assemblies having a total height dimension less than a sum of a height dimension of said first assembly and a height dimension of said second assembly.

11. The nestably stackable assembly of claim 8 wherein said support wires are arranged in pairs with each pair of said support wires being angled downwardly and inwardly toward one another.

12. The nestably stackable assembly of claim 11 wherein each pair of support wires define an acute angle therebetweeen.

13. The nestably stackable assembly of claim 11 wherein each pair of support wires define an included angle of approximately 35° therebetween.

14. A bedding foundation comprising:

a rectangular base;

a nestably stackable wire core assembly fixedly attached atop said base;

a foam pad overlying said nestably stackable assembly; and a fabric covering overlying said pad and sides of said wire core assembly and said base;

said nestably stackable assembly comprising:

a rectangular border wire having two parallel sides and two parallel ends;

transversely spaced, parallel and longitudinally extending support wires parallel to said border wire sides and having ends connected to said border wire ends, said support wires being formed so as to be generally corrugated along their lengths, said corrugatedly formed support wires having peaks and valleys, said peaks being flattened at their tops, said flattened peaks being generally co-planar with a plane defined by said border wire, said valleys being vertically displaced beneath and intermediate of said flattened peaks; and longitudinally spaced, parallel and transversely extending upper connector wires parallel to said border wire ends and having ends connected to said border wire sides, said upper connector wires being connected intermediate of their ends along their lengths to said flattened peaks of said support wires; and said valleys of said support wires having generally inverted U-shaped channels formed at the bottom thereof, said channels of said valleys being located over top and side wall surfaces of slats of said bed base.

15. The bedding foundation of claim 14 wherein a top section of each channel of said valleys of said support wires is stapled to said top surface of slats of said bed base.

16. The bedding foundation of claim 14 wherein side wall sections of said channels of said valleys of said support wires have barbs formed on an inside surface thereof, said barbs being located within sides of said slats for securing said wire core assembly to said base.

* * * * *